US005228689A

United States Patent [19]

Donofrio, Sr.

[11] Patent Number: 5,228,689

[45] Date of Patent: Jul. 20, 1993

[54] GOLF CLUB WITH LOFT ADJUSTING MEANS

[76] Inventor: Frank C. Donofrio, Sr., 720 Buttonwood St., Norristown, Pa. 19401

[21] Appl. No.: 864,310

[22] Filed: Apr. 6, 1992

[51] Int. Cl.[5] ..... A63B 53/06

[52] U.S. Cl. ..... 273/79; 273/80.1; 273/193 B

[58] Field of Search ..... 273/79, 80.1, 80.2, 273/168, 193 B

[56] References Cited

U.S. PATENT DOCUMENTS

| | | | |
|---|---|---|---|
| 1,083,434 | 1/1917 | Curry | 273/79 |
| 1,206,104 | 11/1916 | Goodrich | 273/79 |
| 1,250,301 | 12/1917 | Goodrich | 273/79 |
| 1,529,959 | 3/1925 | Martin | 273/79 |
| 2,179,034 | 11/1939 | Duncan | 273/79 |
| 2,477,438 | 7/1949 | Brouwer | 273/79 |
| 3,477,720 | 11/1969 | Saba | 273/79 |
| 3,601,399 | 8/1971 | Agen et al. | 273/79 |
| 4,878,666 | 11/1989 | Hosoda | 273/80.1 X |

FOREIGN PATENT DOCUMENTS

| | | | |
|---|---|---|---|
| 1048806 | 8/1953 | France | 273/79 |

*Primary Examiner*—V. Millin
*Assistant Examiner*—William M. Pierce

[57] ABSTRACT

A multi-loft golf club that provides a golfer with a more conventional mode of play. More than one club can make up a set. A six iron lofted head mounted in line with the shaft hozel can be closed incrementally to yield eight club positions, a 6,5,4,3,2,1, driver and a putter. The second club, with a 60 degree lofted head mounted in line with the shaft hozel can in a like manner yield eight club positions, a 60 degree sand wedge, 56 degree wedge, 52 degree wedge, pitching wedge, 9,8,7, and another 6 iron . . .being useful when a second player shares the club set. The high lofted club being broader in the club face and with more weight is fitted with a shorter club shaft and the low lofted club with less weight being fitted with a longer club shaft for greater distance; requiring higher velocity. Each club is comprised of a club head, a selector plate, a shaft hozel, a shaft, a shaft grip and fasteners which are mounted to the shaft hozel; when loosened slightly, frees the selector plate to change club-head loft. The selector plate with club head attached, changes the loft via a slotted network. Two radial slots in the selector plate provide a path to intersecting club change slots which are positioned on angles incrementally spaced and converge on a theoretical center point at the bottom leading edge of the iron head. This method of pivoting for loft negates the need for a fastener at the bottom which, when pivoting, creates leading edge offset on each selection where a different point of contact is presented with the ball with each swing.

3 Claims, 1 Drawing Sheet

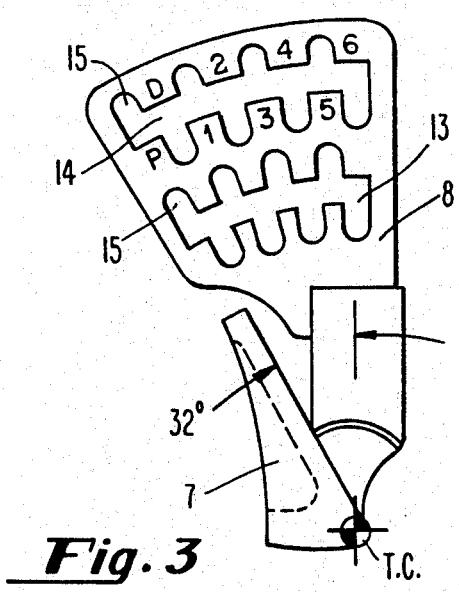
Fig. 3
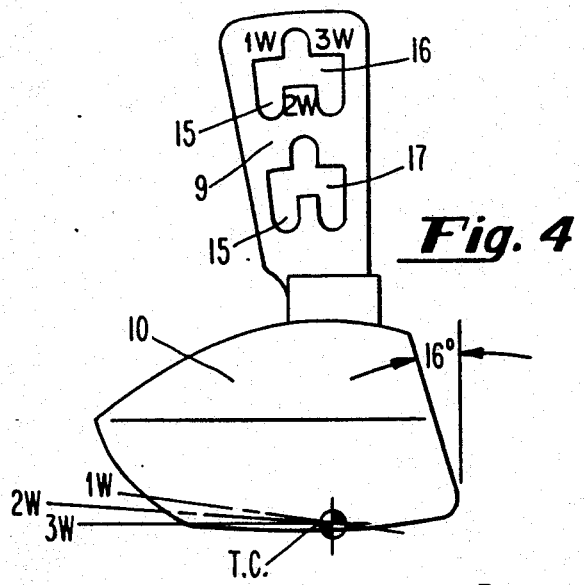
Fig. 4
Fig. 1
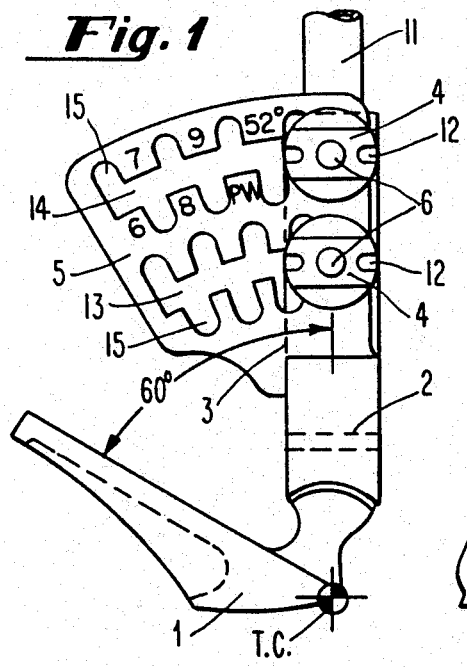
Fig. 2
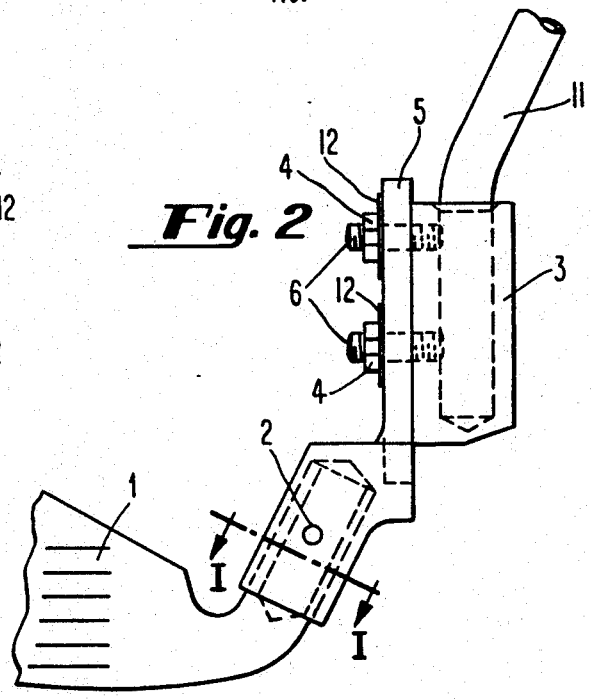
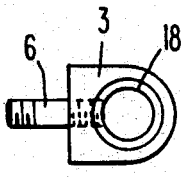
Fig. 5
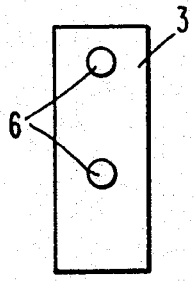
Fig. 6
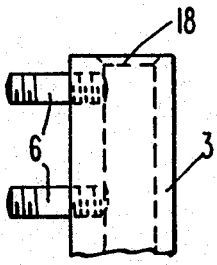
Fig. 7
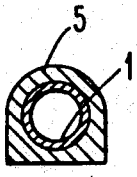
Fig. 8

GOLF CLUB WITH LOFT ADJUSTING MEANS

BACKGROUND OF THE INVENTION

Recently, several multi-loft golf clubs have been introduced on the market. Comparing these with this type of club designed in the past, disadvantages continue to be incorporated. A fastener or rod near the bottom of the club face is being used as a pivot to change loft. Pivoting in this manner, creates offset in the bottom leading edge of the club face, requiring compensation of each swing. (See abstract). Further, it was observed, the pivot fastener on a recent model was lowered to the bottom of the club face. While reducing the offset, this design introduces interference with the ground by adding an additional length to the sole of the club face as a projection at the heel. This projection can make initial contact with the turf, spoiling the shot by digging in and closing the club face with the uneven force on the sole; especially on a side hill, downward lie. This problem is alleviated by the pivoting of the club head above the hitting area, as in the invention presented herein. This method leaves the club head standard and its surface intact; void of obstructions, openings, grooves, pins, splines, springs, etc; which upon impact, all manner of debris can be forced into any moving part . . . being compounded by wear. The design described herein, dramatically eliminates this problem area.

It is the intent also of this design, to produce a multi-loft golf club that has the fewest number of moving parts, a two point positive clamping arrangement, shafts without need to adjust for length, a club design which compensates for wear and a golf club when debris is present, can be seen and brushed off. Further, this invention allows for a change in the number of positions, on the selector plate. A complete set of club positions can be provided on one club. More than one club that can be shared is favored, because appropriate weight and shaft length for each club will bring play closer to the norm.

This invention also features a constant upright lie. (The angle that the shaft makes with the ground when addressing the ball). The upright lie brings the ball closer to the player's feet; making all shots play similar . . . from the long shots, to the putter. Since the selector plate is oriented perpendicular to the ground plane, and the shaft hozel is also in a vertical plane, the shaft can be bent to an upright lie. Choking down on the grip, for in between shots, does not disturb the upright lie. Also, the shaft length can vary with the height of the player.

The fairway wood club heads are also adaptable to the concept herein; for example, a prelofted three wood head of 16 degree loft, can be closed incrementally to 12 degrees for a lofted driver, or closed further to 8 degrees for a less lofted driver. The three wood being used directly on the fairway, while the drivers are used with teed-up balls, where the slight cocking of the club head causes no interference of the trailing bottom edge of the club head with the ground. The club positions on the selector plate are reduced; resulting in less weight above the club head hozel.

Since the number of positions can be reduced or increased, various club set combinations can be produced. For example, a four position selector plate can be used on four iron clubs; a super lofted wedge club with . . . 68 degree, 64 degree, 60 degree and 56 degree. A second club could contain . . . a pitching wedge, 9,8, and a 7 iron. A third club could contain . . . a 6,5,4, and a 3 iron, while a fourth club could contain . . . a 2,1, driving iron, and a putter. The same four position selector plate can be used for the above wood club if desired. This five club set can easily service two players by sharing. Again, it is apparent that using more than one multi-loft club, immeasurably enhances the playability by tailoring the weight of the club head and the length of the shaft for each club grouping. Also, the club head sole in reference to the ground is closer to normal than if just one multi-loft club is used.

BRIEF DESCRIPTION OF THE DRAWING

FIG. 1 is a front elevation view showing a 60 degree iron head hozel mounted in the selector plate hole. Clamping hardware is shown.

FIG. 2 is a partial side elevation view of FIG. 1.

FIG. 3 is a front elevation view of a selector plate mounted to a 6 iron club head of 32 degrees. No other parts are shown.

FIG. 4 is a front elevation view of a three position selector plate: with a 16 degree 3 wood mounted similar to FIG. 2. No other parts are shown.

FIG. 5 is a top view of the shaft hozel with clamping studs.

FIG. 6 is a front elevation of the shaft hozel with clamping studs.

FIG. 7 is a partial side elevation view of the shaft hozel with clamping studs.

FIG. 8 is a sectional view along the line I—I in FIG. 2.

DETAILED DESCRIPTION

As shown in FIG. 1, and FIG. 2, the invention is comprised of a club head 1, a selector plate 5, a shaft hozel 3, a shaft 11, two threaded studs 6, a pin 2, two washers 12, and two elongated slotted nuts 4. The shaft grip is not shown. Standard industry assembly practices are utilized in this invention as appropriate . . . The hozel of the club head 1, is epoxyed and pinned 2, when inserted in the receiving hole in the selector plate 5. Epoxy is also used to secure the shaft 11, in the hole of the shaft hozel 3. The threaded studs 6, are screwed into the female threads of the shaft hozel 3, and secured with epoxy. A further holding of the shaft 11, against loosening from the shaft hozel 3, is accomplished by indenting the shaft 11, at two points coincident with the two threaded studs 6, which creates a two point lock. The pin 2, is not needed here. The relief 18, when filled with epoxy protects the shaft from sharp edge. The front elevation view FIG. 1, and the side elevation view FIG. 2, show the large load distributing washers 12, and the two elongated slotted nuts 4, mounted on the two threaded studs 6, which are securing the selector plate 5, to the front vertical plane of the shaft hozel 3. Since the radial slots 13, and 14, originate from the center Point T. C., (theoretical center) it is obvious that the bottom leading edge of the club face of the club head 1, will remain in a constant position for all club selections. It is also obvious that if a physical pivot or fastener were to be used in the area of the I. C., an off-set of the bottom leading edge of the club head 1, would result with each selection...an amount equal to the distance from the center of the pivoting. means, to the front bottom leading edge of the club face of club head 1. This off-set is detrimental; requiring the player to compensate for each shot.

FIG. 1, shows the threaded studs 6, engaging the selector plate 5, within the radial slots 13, and 14. This condition is shown to reveal an unacceptable clamping position for this invention, where on impact, slippage would occur regardless of how tight the selector plate 5, was clamped. However, by using the radial slots only as a means to position a particular set of intersecting slots, 15, to be in line with the threaded studs 6, and moving the selector plate 5, up or down to engage the intersecting slots 15, a positive positioning and clamping results. To change positions, a slight loosening of the two elongated slotted nuts 4, is required to free the selector plate 5, and choose another club. The washers 12, are made large to overlap the slotted areas, helping to prevent wear of the selector plate 5, and allow for a larger clamping area. The elongated slotted nuts 4, are designed to be used with some of the golf shoe spike wrenches that are on the market. The slotted ends will receive the two projecting pins of this wrench type. Some are available with a ratchet feature; enabling a quick actuation of the elongated slotted nuts.

FIG. 1, shows a golf club which utilizes a 60 degree lofted club head and can be closed incrementally to yield eight clubs and stop at a 6 iron. Using a second club with the same size selector plate 8, in FIG. 3, and with a club head 7, which is a 6 iron, eight more clubs are available. A 6 iron position is repeated, and can be incrementally closed to a putter. The invention is not limited to the club set of FIG. 1, and FIG. 3. See "BACKGROUND OF THE INVENTION".

While the upright lie of the club head and selector plate remain constant for all clubs in this design, the shaft length can be varied to accommodate the height of the player. The configuration of the multi-loft golf club depicted and described herein, dictates considerations of material types, weight and overall balance to result in a center of gravity point in the club face hitting area. Primarily, the club head weight must be re-distributed, and averaged for the club groupings; to balance the weight above and behind the club head hozel. A low center of gravity is most functional.

In a production mode, the club head and selector plate can be cast as one piece; where the parts are oriented in the same position, but having the hozel smoothly integrated, being hollow, and thinning down the selector plate and reducing the number of club positions. The weight above the hozel is kept low also by the nature of the design; where the slotted network "void" saves weight, while functioning as the position change and lock. In FIG. 4, the metal wood club can also be cast as one piece, with a three position selector plate and hollow head.

What is claimed is:

1. A multi-loft golf club comprising; a pre-lofted club head having a front face with toe, heel, top and bottom portions, a back face with toe, heel, top and bottom portions displaced rearwardly from said front face, a sole extending between said front and back bottom portions, a top displaced upward from said sole and extending between said front and back top portions and ahead hozel extending from said heel portions; a shaft having an axis extending between a vertical tip end and a grip end; a shaft hozel with a mouth end mounted to said vertical tip end of said shaft and a flat face angled approximately thirty degrees to said shaft; a selector plate with a plurality of labyrinths for detachably mounting to said flat face with studs and fasteners, said selector plate having a surface surrounded by sides and ends; a hozel-like integral extension attached at one end to said selector plate such that it forms an acute angle from said selector plate surface and having amount at an opposite end fixedly engaging the head hozel by means of a cross pin; said plurality of labyrinths through the surface of the selector plate each comprising a plurality of radial-end slots extending in increments from a plurality of labyrinths through the surface of the selector plate each comprising a plurality of radial-end slots extending in increments from a plurality of concentric annular slots having a radial center at the bottom of the front face and extending a length defined from the front face of the club head to a point coincident with the axis of said shaft when viewed perpendicular to said surface whereby said studs extending through the labyrinths and area mounted to said flat face of said shaft hozel with the selector plate in a preferred angular relationship by means of said fasteners in order to change the loft of the club.

2. The multi-loft golf club of claim 1 wherein said fasteners for detachably mounting said selector plate to said flat face of said shaft hozel comprise threaded nuts having elongated slotted ends adapted to be engaged by a golf shoe spike tool.

3. The multi-loft golf club of claim 2 wherein said studs have locking means and penetrate said flat face of said shaft hozel to fixedly engage coincident detents on said shaft vertical tip end to retain shaft.

* * * * *

UNITED STATES PATENT AND TRADEMARK OFFICE

CERTIFICATE OF CORRECTION

PATENT NO. : 5,228,689

DATED : July 20, 1993

INVENTOR(S) : Frank C. Donofrio, Sr.

It is certified that error appears in the above-indentified patent and that said Letters Patent is hereby corrected as shown below:

Column 2, line 61, change "I.C." to --T.C.--.

Column 4, line 12, change "ahead" to a head.

Column 4, line 22, change "amount" to --a mouth--.

Column 4, lines 27-29, delete "labyrinths through the surface of the selector plate each comprising a plurality of radial-end slots extending in increments from a plurality of".

Column 4, line 34, change "extending" to --extend--.

Column 4, line 35, change "area" to --are--.

Signed and Sealed this

Second Day of November, 1993

*Attest:*

Bruce Lehman

BRUCE LEHMAN

*Attesting Officer*

*Commissioner of Patents and Trademarks*